US005333037A

United States Patent [19]

Inoue et al.

[11] Patent Number: 5,333,037

[45] Date of Patent: Jul. 26, 1994

[54] IMAGE-QUALITY STABILIZER FOR AN ELECTROPHOTOGRAPHIC APPARATUS

[75] Inventors: Katsushi Inoue, Yamatokoriyama; Jitsuo Masuda, Yamatotakada; Teruhiko Noguchi, Sakai; Itaru Kawabata, Kashiba, all of Japan

[73] Assignee: Sharp Kabushiki Kaisha, Osaka, Japan

[21] Appl. No.: 22,740

[22] Filed: Feb. 24, 1993

[30] Foreign Application Priority Data

Mar. 26, 1992 [JP] Japan ..... 4-039781
Jun. 25, 1992 [JP] Japan ..... 4-167653

[51] Int. Cl.[5] ..... G03G 21/00

[52] U.S. Cl. ..... 355/203; 355/208; 355/219; 355/246; 355/274

[58] Field of Search ..... 355/203, 204, 208, 210, 355/214, 219, 246, 271, 273, 274, 276, 296

[56] References Cited

U.S. PATENT DOCUMENTS 5,175,585 12/1992 Matsubayashi et al. ..... 355/208
5,241,347 8/1993 Kodama ..... 355/246

FOREIGN PATENT DOCUMENTS 59-177767 3/1986 Japan ..... 355/273
3-198079 8/1991 Japan ..... 355/275

*Primary Examiner*—A. T. Grimley
*Assistant Examiner*—William J. Royer
*Attorney, Agent, or Firm*—David G. Conlin; Robert F. O'Connell; Kevin J. Fournier

[57] ABSTRACT

An image-quality stabilizer for an electrophotographic apparatus forms a toner patch on a photoreceptor drum, detects the amount of toner attracted to the photoreceptor drum by an optical sensor, and controls each processing device so that the detected value is equal to a reference value which has been detected and stored when the number of image forming operations performed is low. After the control, the toner patch is transferred to a transfer sheet, and the amount of toner remaining on the photoreceptor drum is detected. The reference value is adjusted based on the detected value so as to compensate for a lowering of transfer efficiency. Or the lowering of transfer efficiency is compensated by controlling variables such as transfer output so that the detected value is equal to a reference residual value which has been detected and stored when the number of image forming operations performed is low. This arrangement restrains a lowering of image density due to a change in the transfer efficiency. It is therefore possible to control stabilizing the image quality accurately and to form images of stable quality.

17 Claims, 11 Drawing Sheets

IMAGE-QUALITY STABILIZER FOR AN ELECTROPHOTOGRAPHIC APPARATUS

FIELD OF THE INVENTION

The present invention relates to an image-quality stabilizer used in an electrophotographic apparatus, which forms stable images by controlling each electrophotographic processing device based on the density of a reference toner image.

BACKGROUND OF THE INVENTION

In electrophotographic apparatuses such as copying machines and laser printers, the surface potential of a photoreceptor largely varies with environmental changes. The surface potential of the photoreceptor is gradually lowered by mechanical stress. This is because mechanical stress, such as abrasion by a cleaning blade, is accumulatively applied to the photoreceptor during repeatedly preformed image forming operations, and the thickness of a photosensitive layer on the photoreceptor is reduced. Such changes in the surface potential of the photoreceptor greatly affect the image quality, for example, cause a decrease in the image density.

For example, in a device disclosed in Japanese Publication for Examined Patent Application No. 29502/1986, an electrostatic latent image formed on a photoreceptor is first read. Then, the formation of electrostatic latent image is controlled based on the results to give stability to the image quality. There is also a device provided with an optical sensor for detecting the optical density of a reference toner image called a toner patch. In the device of this type, a charging voltage and a discharge voltage are controlled during electrophotographic processes so that the optical density of a toner patch formed on a photoreceptor to be detected by an optical sensor is equal to a reference value determined to achieve optimal image quality.

In a high-speed copying machine, a pre-cleaning charger is disposed before a cleaning device for removing toner remaining on the photoreceptor after the transfer process. The pre-cleaning charger removes unwanted charges remaining on the photoreceptor. When an output of the pre-cleaning charger exceeds its optimum value, it causes the photoreceptor to be fatigued and insufficient cleaning of toner charged to the opposite polarity. To prevent such problems, the output of the pre-cleaning charger device is arranged to be within a predetermined range.

In copying machines, however, the image quality is adjusted simply by controlling machine function such as charging, exposure, and developing without controlling a change in transfer efficiency caused by degradation of a developer and environmental changes. Consequently, even when the image quality is adjusted, if there is a change in the transfer efficiency, it affects the quality of the resulting image.

Moreover, in a conventional copying machine, when the transfer efficiency is lowered due to a change in the quality of transfer sheets caused by the deterioration of a transfer device and environmental changes, the amount of toner remaining of the photoreceptor after the transfer process increases, causing degradation of cleaning. However, even in a copying machine having a pre-cleaning charger disposed before a cleaning device, degradation of cleaning due to a change in the transfer efficiency is not taken into account for the control of the output of the pre-cleaning charger.

SUMMARY OF THE INVENTION

It is an object of the present invention to provide an image-quality stabilizer which stabilizes image quality based on transfer efficiency so as to obtain stable image quality even when the transfer efficiency varies. It is another object of the present invention to provide an image-quality stabilizer which achieves stable cleaning performance by controlling charging of a photoreceptor before cleaning based on the transfer efficiency.

In order to achieve the above object, an image-quality stabilizer for an electrophotographic apparatus of the present invention includes:

- optical detecting means for optically detecting an amount of toner deposited on a photoreceptor;
- process control means for controlling electrophotographic processing devices so that an amount of toner forming a reference toner image on the photoreceptor is equal to a predetermined reference value;
- transfer control means for controlling a transfer device so as to transfer a reference toner image formed after controlling the processing devices to a transfer sheet; and
- reference-value adjusting means for adjusting the reference value based on an amount of toner on the photoreceptor detected by the optical detecting means after transferring the reference toner image to the transfer sheet.

With this arrangement, each electrophotographic processing device is controlled so that an amount of toner forming the reference toner image detected by the optical sensor is equal to the reference value. Then, a reference toner image is formed on the photoreceptor, and transferred to a transfer sheet by the transfer control means.

After transfer, the amount of toner remaining on the photoreceptor is detected by the optical sensor. And the reference-value adjusting means adjusts the reference value based on the detected value. When the transfer efficiency is lowered and the image density is decreased after a great number of image forming operations, the amount of toner remaining on the photoreceptor after transfer increases. In this case, the reference value is adjusted so as to increase the amount of toner forming the reference toner image. On the other hand, when the amount of toner remaining on the photoreceptor after transfer decreases, the reference value is adjusted so as to reduce the amount of toner forming the reference toner image.

Namely, the process control is performed based on the reference value adjusted according to the amount of toner remaining on the photoreceptor after transfer. Therefore, even when the transfer efficiency varies, it is possible to adjust the image quality appropriately, achieving stable image quality.

In order to achieve the above object, an alternate image-quality stabilizer of the present invention includes:

- optical detecting means for optically detecting an amount of toner deposited on a photoreceptor;
- process control means for controlling electrophotographic processing devices so that an amount of toner forming a reference toner image on the photoreceptor is equal to a predetermined reference value;

transfer control means for controlling a transfer device so as to transfer a reference toner image formed after controlling the processing devices to a transfer sheet; and control means which controls the value detected by the optical sensor after the transfer of the reference toner image to be equal to a reference residual value detected by the optical detecting means when the reference toner image for determining the reference value is transferred to the transfer sheet. The control means is either (1) transfer-output control means for controlling the output of a transfer device, (2) separation-output control means for controlling the output of a separating device in accordance with the output of the transfer device controlled by the transfer-output control means, (3) charger-output control means for controlling the output of a charger, (4) pre-transfer charger output control means for controlling the output of a pre-transfer charger for removing charges on the photoreceptor immediately before transfer, (5) pre-transfer light quantity control means for controlling the quantity of light of a pre-transfer lamp used for removing the charges on the photoreceptor immediately before the transfer, and (6) developer supply control means for controlling the amount of developer to be supplied.

With this arrangement, when the optical sensor detects the amount of toner remaining on the photoreceptor after transfer, controlled variables are controlled so that the detected value is equal to the predetermined reference residual value.

In an image-quality stabilizer having the transfer-output control means, the output of the transfer device is controlled by the transfer-output control means. For example, when a great amount of toner is attracted to the photoreceptor, the amount of toner transferred to the transfer sheet is small. In this case, the output of the transfer device is raised to cause an increased amount of toner to be transferred to the transfer sheet. On the other hand, when the amount of toner transferred to the transfer sheet is great, the output of the transfer device is lowered.

In an image-quality stabilizer having the separation-output control means, the output of the separating device is controlled by the separation-output control means according to the output of the transfer device. Consequently, the transfer sheet and the photoreceptor are separated optimally, preventing defective separation of transfer sheet and defective transfer of the toner image.

In an image-quality stabilizer having one of the charger-output control means, the pre-transfer charger output control means, the pre-transfer light quantity control means and the developer supply control means, the control variables are controlled so that the value detected by the optical sensor after transfer is equal to the reference residual value. Namely, the output of the charger is controlled by the charger-output control means, the output of the pre-transfer charger is controlled by the pre-transfer charger output control means, the quantity of light of the pre-transfer lamp is controlled by the pre-transfer light quantity control means, and the amount of the developer to be supplied is controlled by the developer supply control means. Each processing device is controlled by a correction value calculated, for example, for a difference between the value detected by the optical sensor after transfer and the reference residual value, or a change in the transfer efficiency.

As described above, with this arrangement, each variable is controlled based on the amount of toner remaining on the photoreceptor after transfer. Therefore, even when the transfer efficiency varies, it is possible to adjust the image quality appropriately and to form images stably.

In order to achieve another object, another image-quality stabilizer for an electrophotographic apparatus includes:

optical detecting means for optically detecting an amount of toner deposited on a photoreceptor;

process control means for controlling electrophotographic processing devices so that an amount of toner forming a reference toner image on the photoreceptor is equal to a predetermined reference value;

transfer control means for transferring to a transfer sheet a reference toner image formed after controlling the processing devices; and pre-cleaning charger output control means which calculates a transfer efficiency from the amounts of toner on the photoreceptor detected by the optical detecting means before and after transferring the reference toner image, and controls the output of a pre-cleaning charger for removing charges on the photoreceptor immediately before cleaning according to the transfer efficiency.

With this arrangement, each electrophotographic processing device is controlled so as to make the amount of toner forming the reference toner image equal to the reference value for stabilizing the image quality. In this case, the density of a reference toner image formed on the photoreceptor is detected by an optical sensor before and after the transfer control means transfers the reference toner image. Then, a transfer efficiency is calculated from these two detected values. Based on the transfer efficiency an optimum output of the pre-cleaning charger is determined. Thus, cleaning is performed appropriately in accordance with a change in the transfer efficiency.

For a fuller understanding of the nature and advantages of the invention, reference should be made to the ensuing detailed description taken in conjunction with the accompanying drawings.

DESCRIPTION OF THE EMBODIMENTS

EMBODIMENT 1

Figure 1:
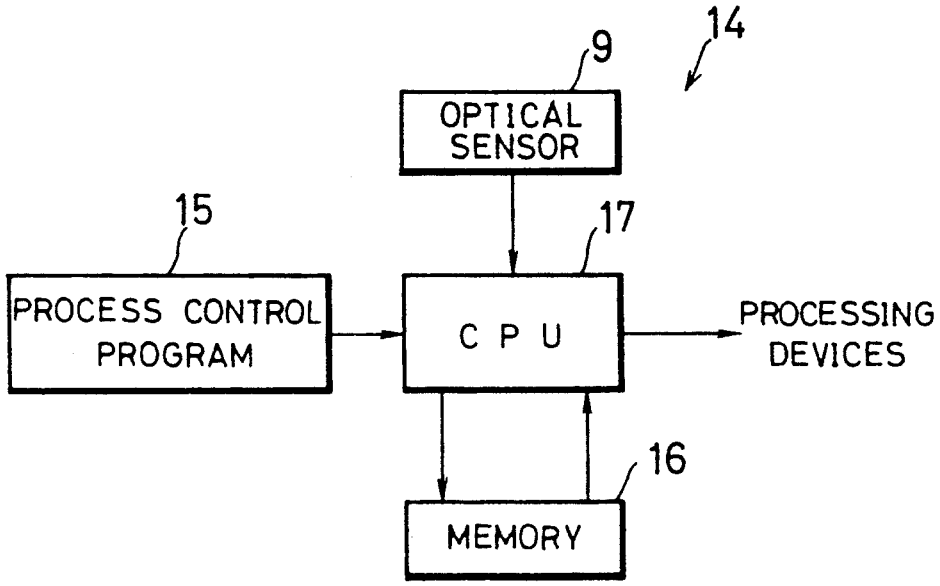
FIG. 1 is a block diagram illustrating a schematic structure of the process control section of an electrophotographic apparatus according to a first embodiment of the present invention.
Figure 2:
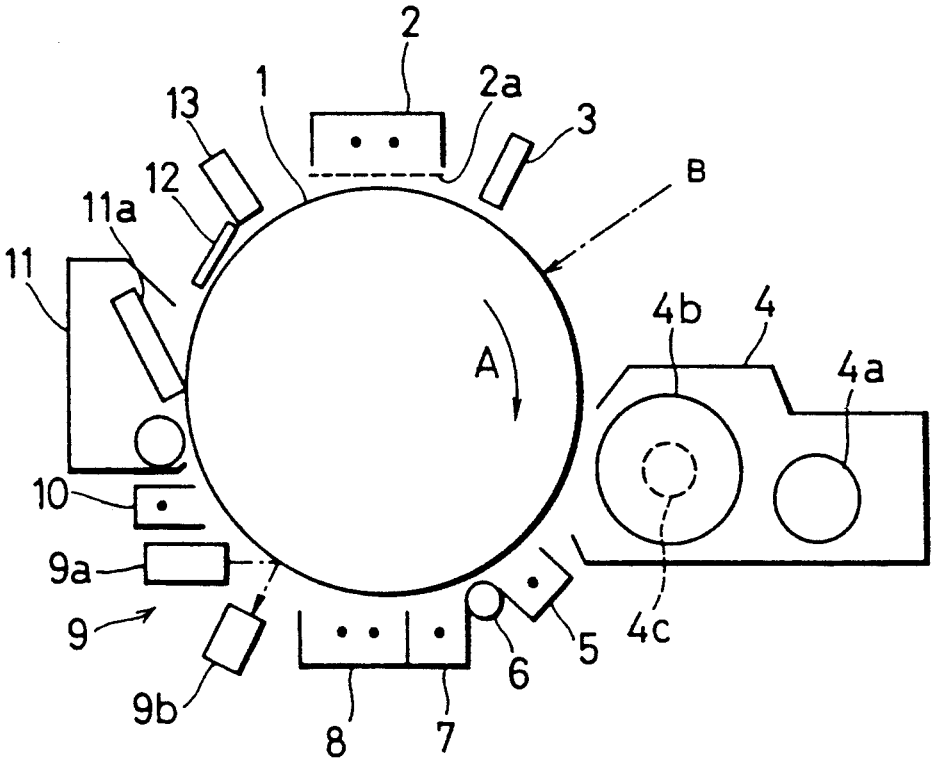
FIG. 2 shows a structure of essential components of a processing section in electrophotographic apparatuses according to first through seven embodiments of the present invention.
Figure 3:
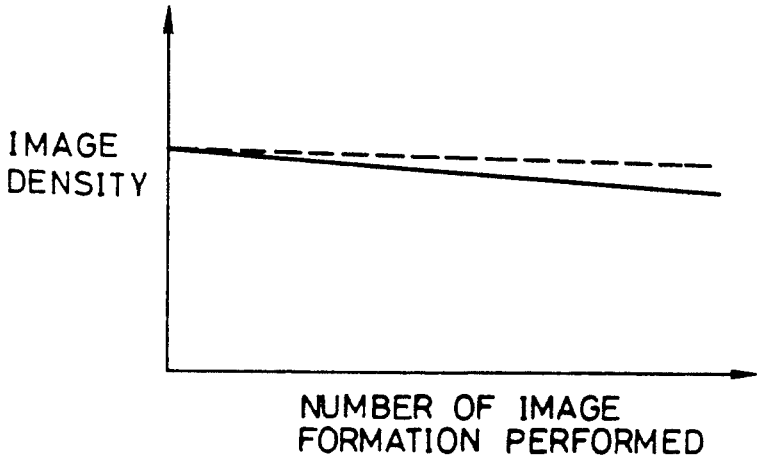
FIG. 3 is a graph showing the relation between the number of image forming operations performed and the image density when the process control section of FIG. 1 stabilizes the image quality.

The following description discusses a first embodiment of the present invention with reference to FIGS. 1 through 3.

As illustrated in FIG. 2, an electrophotographic apparatus of this embodiment has a photoreceptor drum 1. When an image of a document is exposed to light travelling in the B direction shown in FIG. 2, an electrostatic latent image is formed on the photoreceptor drum 1 rotating in the A direction in the apparatus.

A scorotron type charger 2 for charging the photoreceptor drum 1 is disposed just above the photoreceptor drum 1. The charger 2 has a grid electrode 2*a*, and its output is controlled by controlling a grid voltage to be applied to the grid electrode 2*a*.

Disposed around the photoreceptor drum 1 are a blank lamp 3, a development device 4, a pre-transfer charger 5, a pre-transfer lamp 6, a transfer device 7, a separating device 8, an optical sensor 9, a pre-cleaning charger 10, a cleaning device 11, a discharge lamp 12, and a fatigue lamp 13.

The blank lamp 3 is composed of LEDs and irradiates light on a non-image area of the photoreceptor drum 1, which does not face the document.

The development device 4 has an agitating roller 4*a* and a magnet roller 4*b* therein. The agitating roller 4*a* agitates a two-component developer and produces charges between toner and a carrier by friction. The magnet roller 4*b* includes a cylindrical non-magnetic sleeve forming its housing and magnetic poles therein. The sleeve is rotated by a rotation driving force transmitted through a clutch 4*c*. The magnet roller 4*b* produces a magnetic brush by causing the developer to be attracted to the sleeve through magnetic forces of the magnetic poles. The developer is supplied to the photoreceptor drum 1 with the rotation of the sleeve.

A pre-transfer charger 5 removes the charges on the photoreceptor drum 1 by a corona discharge of a polarity which is opposite to that of the output of the charger 2 and equal to that of toner before toner deposited on the electrostatic latent image is transferred to a transfer sheet. Consequently, the force of attraction between toner and the photoreceptor drum 1 is weakened. The pre-transfer lamp 6 removes the charges forming the electrostatic latent image by irradiating light thereon, thereby weakening the force attraction between toner and the photoreceptor drum 1.

The transfer device 7 transfers the toner image on the photoreceptor drum 1 to the transfer sheet by a corona discharge of a polarity equal to the polarity of the output of the charger 2. The separating device 8 applies an a.c. corona discharge to the photoreceptor drum 1 and weakens the force of attraction between the toner and the photoreceptor drum 1 so that the transfer sheet carrying thereon the toner image is separated from the photoreceptor drum 1.

After the separation process, the transfer sheet carrying the toner image is transported to a fusing device, not shown. At the fusing device, heat and pressure are applied to the toner image so as to heat-fuse the image.

The optical sensor 9 includes a light emitting diode 9*a* and a photo-transistor 9*b*. The optical sensor 9 uses the photo-transistor 9*b* to receive light irradiated by the light emitting diode 9*a* and reflected by the photoreceptor drum 1, detects the amount of toner deposited on the photoreceptor drum 1 through the amount of light received, and outputs an electric signal indicating the detected value. When the amount of toner increases, the amount of light reflected by the photoreceptor drum 1 becomes smaller, and thereby producing a weaker electric signal. On the other hand, when the amount of toner decreases, the amount of light reflected by the photoreceptor drum 1 becomes greater, and thereby producing a stronger electric signal.

The pre-cleaning charger 10 for removing unnecessary charges remaining on the photoreceptor drum 1 is disposed below the cleaning device 11. The cleaning device 11 removes the toner on the photoreceptor drum 1 by scraping toner from the photoreceptor drum 1 and collecting toner with a blade 11*a*.

The discharge lamp 12 removes charges remaining on the photoreceptor drum 1 by irradiating light thereon. The fatigue lamp 13 irradiates light on the photoreceptor drum 1 for removing charges that still remain on the photoreceptor drum 1 after the irradiation of light by the discharge lamp 12 and causes the photoreceptor drum 1 to be fatigued to a predetermined degree so as to prevent a variation in the image density each time an image is formed.

As illustrated in FIG. 1, the electrophotographic apparatus of this embodiment includes a process control section 14 as process control means for controlling the above-mentioned electrophotographic processing devices. The process control section 14 includes the optical sensor 9 as optical detecting means, a process control program 15 stored, for example, in a ROM, a memory 16 for storing the detection output of the optical sensor 9, and a CPU 17 which controls each electrophotographic processing device based on the process control program 15.

At an early stage, i.e. when a total number of image forming operations performed is low, the CPU 17 performs the following operations.

(A) When the optical sensor 9 reads a toner patch as a reference toner image, its detection output (hereinafter referred to as sensor output before transfer) is stored in advance in the memory 16 as a reference value.

(B) The toner patch is transferred to a transfer sheet, and an output of the optical sensor 9 indicating the amount of the toner remaining on the photoreceptor drum 1 after transfer (hereinafter referred to as sensor output after transfer) is stored in the memory 16 as a reference residual value.

Every time a predetermined number of imaging operations are performed, the CPU 17 performs the following operations in order to stabilize the image quality and to correct the reference value.

(A) Stabilizing the image quality by controlling each processing device so that the optical sensor 9 produces an output equal to the reference value when it reads a toner patch on the photoreceptor drum 1 before transfer.

(B) Forming a toner patch after controlling each processing device and transferring the toner patch to a transfer sheet.

(C) Calculating a correction value for the reference value based on the ratio of the sensor output after transfer to the residual toner reference value, and the reference value.

When the CPU 17 executes the process control program 15, the process control section 14 functions as transfer control means and reference-value adjusting means.

The following description discusses how process control is performed for stabilizing image quality according to the above-mentioned arrangement.

First, when a toner patch is formed on the photoreceptor drum 1, a sensor output before transfer produced by the optical sensor 9 is stored in the memory 16 as a reference value $T_1$. Then, when the toner patch is transferred to a transfer sheet, a sensor output after transfer produced by the optical sensor 9 is stored in the memory 16 as a reference residual value $S_1$.

Thereafter, a toner patch is formed every time a predetermined number of image forming operations are performed, and the optical sensor 9 produces a sensor output before transfer with respect to the toner patch. The sensor output before transfer thus obtained is compared with the reference value $T_1$. Based on the results of the comparison, controlled variables for each processing device, such as the intensity of exposure, the output of the charger and the development bias voltage, are determined so that the sensor output before transfer is equal to the reference value $T_1$. And, process control is performed using these values.

After the process control is performed, the toner patch is transferred to the transfer sheet, and the resulting sensor output after transfer is stored in the memory 16 as a comparative residual value $S_2$. Then, a reference correction value $T_2$ for the process control is given $$T_2 = T_1 \times S_2 / S_1$$

And, the reference value $T_1$ is updated as the reference correction value $T_2$ so that the transfer efficiency $S_2/T_2$ obtained after a predetermined number of image forming operations is equal to the transfer efficiency $S_1/T_1$ obtained when the total number of image forming operations performed was low. Process control is performed using the reference correction value $T_2$ until this updated value is further updated so as to adjust the density of the toner patch.

A conventional electrophotographic apparatus performing process control without considering transfer efficiency shows such a characteristic illustrated by the solid line in FIG. 3 when there is no environmental change. More specifically, when a total number of image forming operations performed is low, the highest image density is achieved and stable image quality is obtained. Then, the image density decreases as the number of image forming operations performed increases due to changes in transfer efficiency.

On the other hand, with process control performed in the electrophotographic apparatus of this embodiment, the reference value for the sensor output before transfer is corrected so as to maintain the transfer efficiency obtained when the total number of image forming operation performed was low. Therefore, even if the transfer efficiency varies due to a change in the developer after a greater number of image forming operations, the image density is restrained from being lowered as shown by the broken line in FIG. 3.

EMBODIMENT 2

The following description discusses a second embodiment of the present invention with reference to FIGS. 2, 4 through 6.

As illustrated in FIG. 2, an electrophotographic apparatus of this embodiment has a processing section including the photoreceptor drum 1 and the transfer device 7 disposed in the vicinity thereof.

Figure 4:
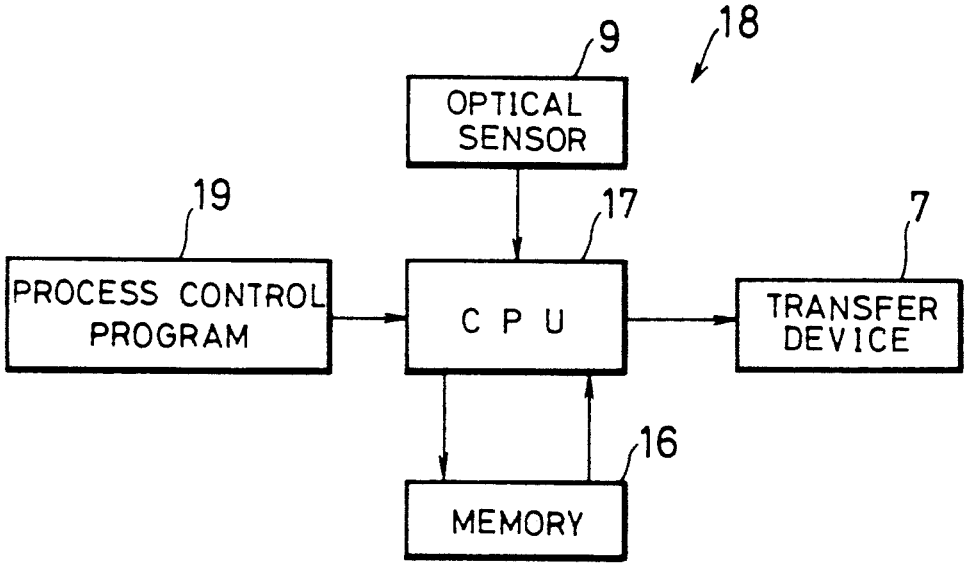
FIG. 4 is a block diagram illustrating a schematic structure of the process control section of the electrophotographic apparatus according to a second embodiment of the present invention.

Moreover, as illustrated in FIG. 4, the electrophotographic apparatus has a process control section 18 as process control means. The process control section 18 includes the optical sensor 9, a process control program 19, the memory 16, and the CPU 17.

The CPU 17 stores the ratio of a sensor output before transfer to a sensor output after transfer as reference transfer efficiency in the memory 16 when a total number of image forming operations performed is low. And, the CPU 17 controls the output of the transfer device 7 so that a transfer efficiency equal to the reference transfer efficiency is obtained when stabilizing the image quality.

Thus, when the CPU 17 executes the process control program 19, the process control section 18 functions as first control means as well as transfer control means.

Next, the relation between the transfer efficiency and the transfer output are explained below.

Figure 5:
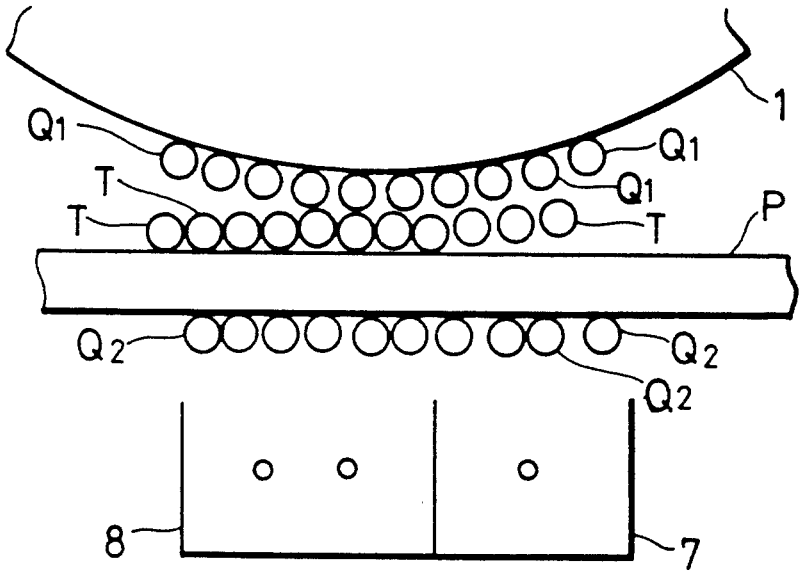
FIG. 5 is a view explaining the states of the photoreceptor drum, a transfer sheet and toner during transfer and separation processes.

As illustrated in FIG. 5, toner T attracted to charges $Q_1$ forming an electrostatic latent image on the photoreceptor drum 1 is attracted to a transfer sheet P by charges $Q_2$. The charges $Q_2$ have a polarity equal to the polarity of the charges $Q_1$ and are generated on the underside of the transfer sheet P by a corona discharge of the transfer device 7.

Figure 6:
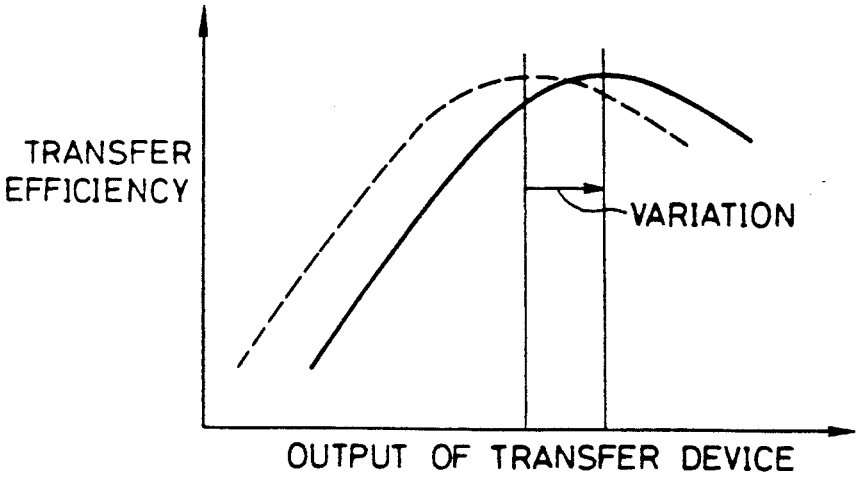
FIG. 6 is a graph showing the relation between the output of a transfer device and transfer efficiency.

With a device having an ordinary transfer characteristic shown by the broken line in FIG. 6, when the transfer output is low, it is impossible to attract a great amount of toner T to the transfer sheet P because the amount of charge on the underside of the transfer sheet P is low. However, when the transfer output increases, the amount of charge on the underside of the transfer sheet P increases and the force of attraction between the toner T and the transfer sheet P becomes stronger, thereby attracting an increased amount of toner T to the transfer sheet P. When the transfer output further increases, the amount of charge on the underside of the transfer sheet P increases excessively, causing dielectric breakdown between the upper side and the under side of the transfer sheet P. As a result, the charges $Q_2$ on the underside of the transfer sheet P move to the surface of the photoreceptor drum 1, causing a lowering of the transfer efficiency. The maximum transfer efficiency is around 85% at present.

A look-up table giving a decrease in the transfer efficiency and a corresponding correction value for the transfer output was prepared. As shown in the solid line of FIG. 6, the electrophotographic apparatus of this embodiment compensates for a decrease in the transfer efficiency by adjusting the transfer output in accordance with the change in the transfer efficiency using the correction value given by the look-up table.

The following description explains process control for stabilizing the image quality according to the above-mentioned arrangement.

Firstly, when a toner patch is formed on the photoreceptor drum 1, a sensor output before transfer produced by the optical sensor 9 is stored in the memory 16. Next, when the toner patch is transferred to a transfer sheet, a sensor output after transfer generated by the optical sensor 9 is stored in the memory 16. Then, a transfer efficiency is calculated based on the sensor outputs before and after transfer, and is stored in the memory 16 as reference transfer efficiency. Thereafter, a toner patch is formed every time a predetermined number of image forming operations are performed. The output of the transfer device 7 is controlled so that a transfer efficiency equal to the reference transfer efficiency is obtained when the new toner patch is formed.

As described above, the electrophotographic apparatus of this embodiment controls the output of the transfer device 7 in accordance with a decrease in the transfer efficiency. Thus, even when the transfer efficiency varies due to a change in the developer, it is possible to restrain a lowering of image density.

EMBODIMENT 3

The following description discusses a third embodiment of the present invention with reference to FIGS. 2, 5, 7 through 9.

Figure 7:
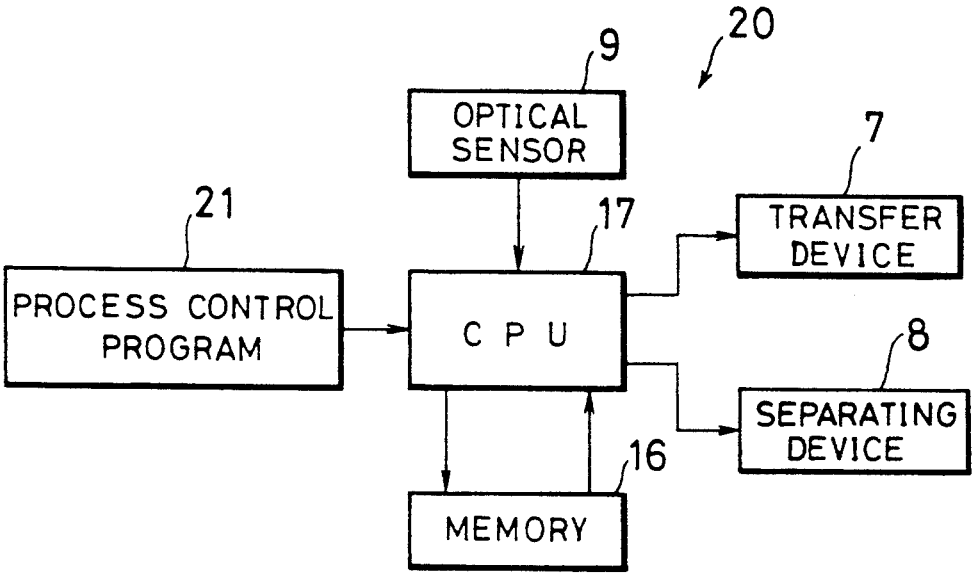
FIG. 7 is a block diagram illustrating a schematic structure of the process control section of the electrophotographic apparatus according to a third embodiment of the present invention.

As illustrated in FIG. 2, an electrophotographic apparatus of this embodiment has a processing section including the photoreceptor drum 1, the transfer device 7 and the separating device 8, disposed in the vicinity of the photoreceptor drum 1. Moreover, as illustrated in FIG. 7, the electrophotographic apparatus has a process control section 20 as process control means. The process control section 20 includes the optical sensor 9, a process control program 21, the memory 16, and the CPU 17.

Similarly to the second embodiment, the CPU 17 controls the output of the transfer device 7. The CPU 17 adjusts the output of the separating device 8 using a look-up table when stabilizing the image quality. The look-up table shows an output of the separating device 8 optimum for a transfer efficiency to be corrected.

Thus, the process control section 20 functions as first and second control means as well as transfer control means when the CPU 17 executes the process control program 21.

Next, the relation between the transfer efficiency and the output of the separating device 8 is explained below.

During the separation process after transfer, as illustrated in FIG. 5, when excessive charges $Q_2$ on the underside of the transfer sheet P are removed by an a.c. corona discharge of the separating device 8, the Coulomb forces between the transfer sheet P and the photoreceptor drum 1 become weaker. As a result, the transfer sheet P is separated from the photoreceptor drum 1 because of its rigidity and weight.

Figure 8:
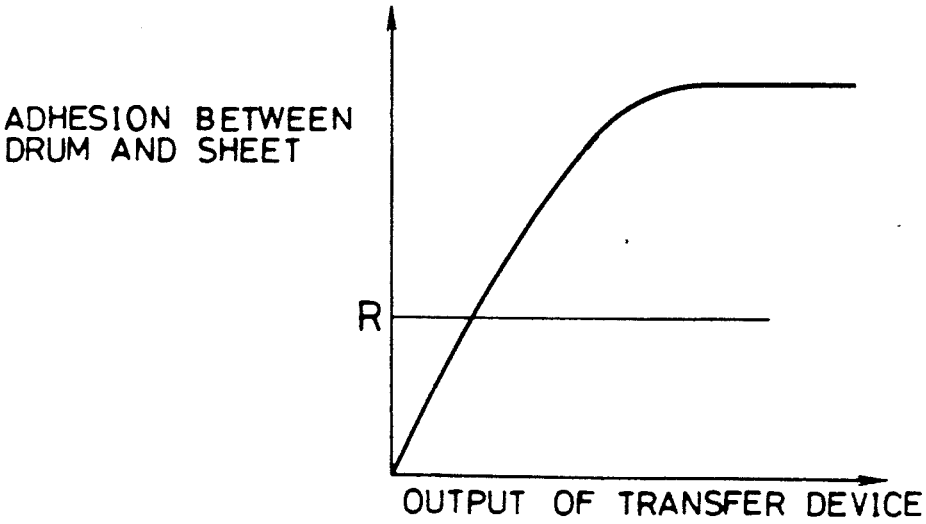
FIG. 8 is a graph showing the relation between the output of the transfer device and the adhesion between the transfer sheet and the photoreceptor drum.

FIG. 8 shows the relation between the output of the transfer device 7 and the adhesion between the photoreceptor drum 1 and the transfer sheet P (hereinafter referred to as the adhesion between drum and sheet). This figure shows that when the output of the transfer device 7 is low, the adhesion between drum and sheet becomes stronger as the output of the transfer device 7 becomes higher. However, when the output of the transfer device 7 exceeds a predetermined value, an anomalous charging voltage is applied to the transfer sheet P. This causes the charges $Q_2$ to leak from the underside of the transfer sheet P to the photoreceptor drum 1 and the adhesion between drum and sheet to be saturated. On the other hand, when the output of the transfer device 7 drops excessively, the adhesion between the transfer sheet P and the toner T becomes weaker, causing a defective transfer. It is thus necessary to set the adhesion between drum and sheet to a value around R in order to separate the transfer sheet P from the photoreceptor drum 1 without causing defective transfer of the toner T.

Figure 9:
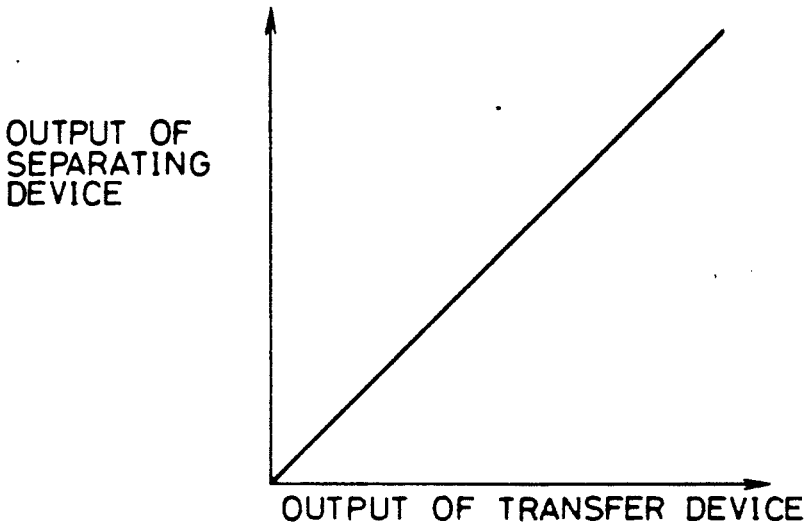
FIG. 9 is a graph showing the relation between the output of the transfer device and the output of a separating device.

In this electrophotographic apparatus, to maintain the adhesion between drum and sheet in the vicinity of R, the output of the separating device 8 is controlled so that the output of the transfer device 7 and the output of the separating device 8 have a proportional relation as shown in FIG. 9.

With this arrangement, when stabilizing the image quality, similar to the second embodiment, the output of the transfer device 7 is controlled based on the transfer efficiency obtained from the outputs of the optical sensor 9 before and after transfer. And, the output of the separating device 8 is controlled according to a change in the output of the transfer device 7. Namely, the transfer efficiency is adjusted by controlling the outputs of the transfer device 7 and the separating device 8.

As described above, the electrophotographic apparatus of this embodiment controls the outputs of the transfer device 7 and the separating device 8 according to a decrease in the transfer efficiency. Therefore, even when the transfer efficiency varies due to a change in the developer, it is possible to restrain the image density from being lowered and to separate the transfer sheet P from the photoreceptor drum 1 without causing a defective transfer of the toner T.

EMBODIMENT 4

The following description discusses a fourth embodiment of the present invention with reference to FIGS. 2, and 10 through 12.

Figure 10:
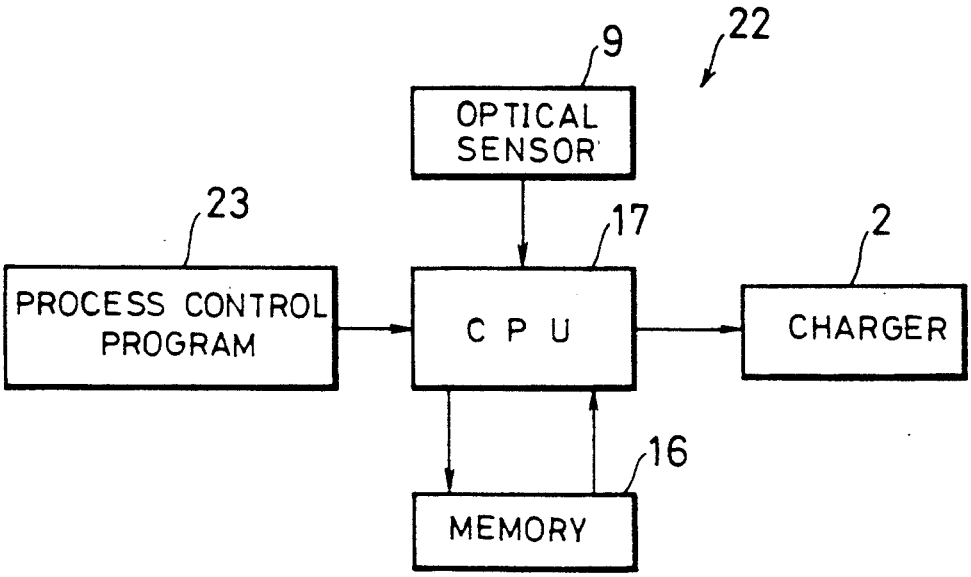
FIG. 10 is a block diagram illustrating a schematic structure of the process control section of the electrophotographic apparatus according to a fourth embodiment of the present invention.

As illustrated in FIG. 2, an electrophotographic apparatus of this embodiment has a processing section including the photoreceptor drum 1, the charger 2, disposed in the vicinity of the photoreceptor drum 1. Moreover, as illustrated in FIG. 10, the electrophotographic apparatus has a process control section 22 as process control means. The process control section 22 includes the optical sensor 9, a process control program 23, the memory 16, and the CPU 17.

To stabilize the image quality based on transfer efficiency, the CPU 17 performs the following operations.

(A) Storing in the memory 16 a sensor output after transfer as a reference residual value when a total number of image forming operations have been performed is low.

(B) Calculating a difference between a sensor output after transfer obtained when stabilizing the image quality and the reference residual value.

(C) Calculating for a charger output a correction value corresponding to the difference of the sensor output and the reference residual value based on the relation between the change in the sensor output after transfer and the change in the charger output.

(D) Controlling a grid voltage of the charger 2 by the correction value.

Thus, the process control section 22 functions as transfer control means as well as third control means when the CPU 17 executes the process control program 23.

The relation between the sensor output after transfer and the charger output is explained below.

Figure 11:
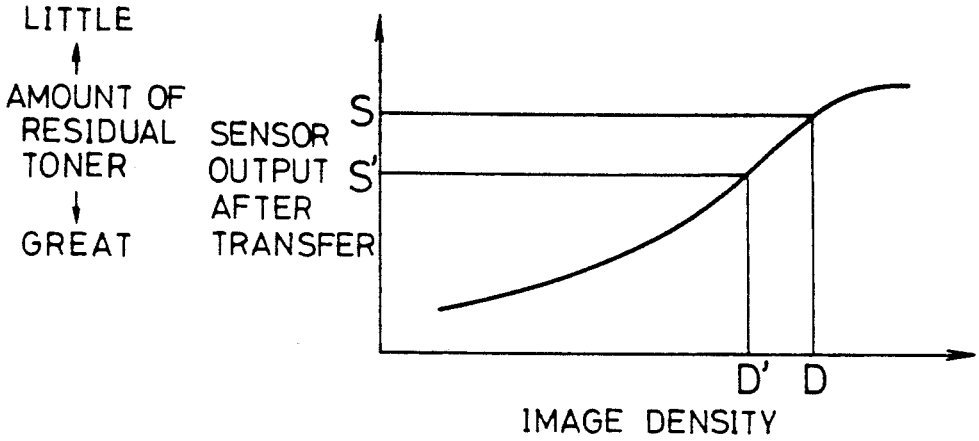
FIG. 11 is a graph showing the relation between the output of an optical sensor after the transfer process and the image density.

FIG. 11 illustrates the relation between the sensor output after transfer and the image density. As the image density increases, the sensor output after transfer draws a moderate upward curve. According to the figure, when the sensor output after transfer drops from S to S', i.e., when the amount of toner remaining on the photoreceptor drum 1 after transfer increases, the image density also decreases from D to D'.

Figure 12:
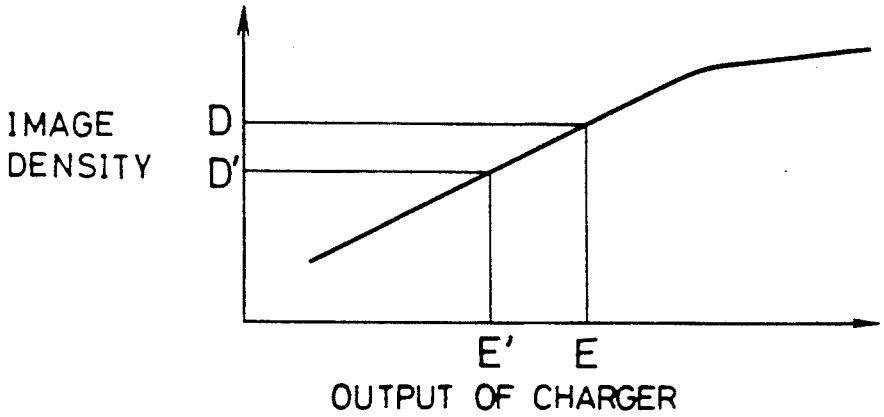
FIG. 12 is a graph showing the relation between the output of a charger and the image density.

FIG. 12 illustrates the relation between the charger output and the image density. When the charger output is not greater than a predetermined value, the relation between them changes as shown by the straight line of FIG. 12. In this figure, when the image density changes from D to D', the charger output changes from E to E'. Therefore, when the sensor output after transfer drops from S to S', the reduction, from D to D,' in the image density is compensated by increasing the charger output by an amount equal to the change from E to E'.

In the electrophotographic apparatus, the lowering of the transfer efficiency is compensated by changing the discharge output of the charger 2 by the correction value obtained through a look-up table. The look-up table was prepared to relate a change in the sensor output after transfer to a correction value for the charger output based on the relation between the charger output and the image density.

According to this arrangement, the process control of stabilizing the image quality is described below.

After adjusting the sensor output before transfer (reference value) based on a toner patch, a toner patch is formed on the photoreceptor drum 1 and transferred to a transfer sheet. Next, an output generated by the optical sensor 9 after transfer is stored in the memory 16 as a comparative residual value. A difference between the comparative residual value and the pre-stored reference residual value is calculated. Then, a correction value for the charger output is determined according to the difference. A grid voltage to be applied to the charger 2 is controlled by the correction value and the amount of residual toner on the photoreceptor drum 1 after transfer is adjusted.

As described above, the electrophotographic apparatus of this embodiment controls the charger output according to a change in the sensor output after transfer. Hence, even if the transfer efficiency varies due to a change in the developer, it is possible to restrain the image density from being lowered.

EMBODIMENT 5

The following description discusses a fifth embodiment of the present invention with reference to FIGS. 2, 11, 13 and 14.

Figure 13:
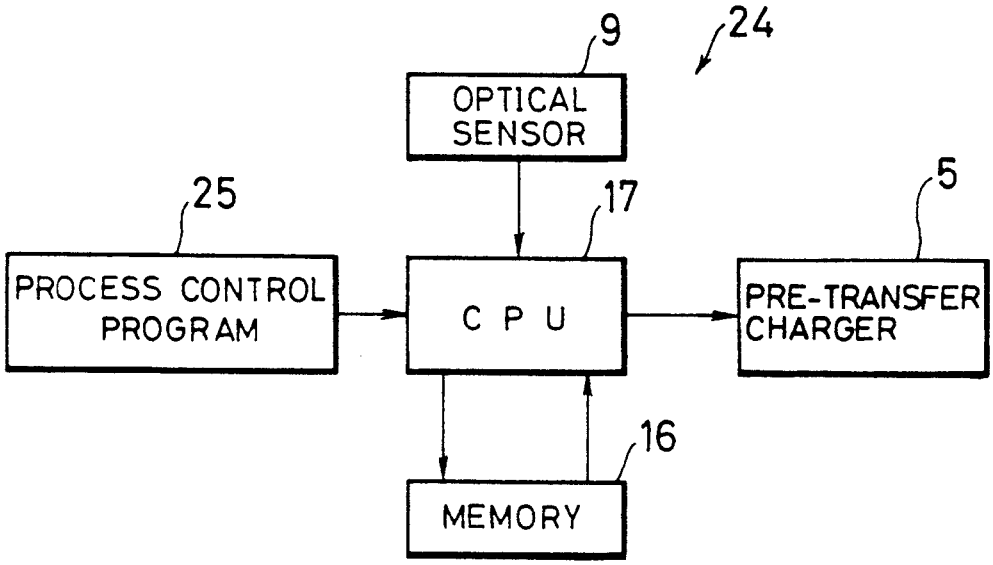
FIG. 13 is a block diagram illustrating a schematic structure of the process control section of the electrophotographic apparatus according to a fifth embodiment of the present invention.

As illustrated in FIG. 2, an electrophotographic apparatus of this embodiment has a processing section including the photoreceptor drum 1, a pre-transfer charger 5 disposed in the vicinity of the photoreceptor drum 1. Moreover, as illustrated in FIG. 13, the electrophotographic apparatus has a process control section 24 as process control means. The process control section 24 includes the optical sensor 9, a process control program 25, the memory 16, and the CPU 17.

To stabilize the image quality based on transfer efficiency, the CPU 17 performs the following operations.

(A) Storing a sensor output after transfer in the memory 16 as a reference residual value when a total number of image forming operations performed is low.

(B) Calculating the ratio of a potential (or experimental) value of a sensor output after transfer obtained in stabilizing the image quality to the reference residual value. The potential value of the sensor output after transfer is hereinafter referred to as a comparative residual value.

(C) Determining a suitable pre-transfer charger output according to the ratio calculated.

(D) Calculating the ratio of an actual comparative residual value obtained when stabilizing the image quality to the reference residual value.

(E) Controlling the total current of the pre-transfer charger 5 by the pre-transfer charger output obtained from the ratio.

Thus, the process control section 24 functions as fourth control means as well as transfer control means when the CPU 17 executes the process control program 25.

Next, the relation between the ratio of the comparative residual value to the reference residual value and the pre-transfer charger output is explained below.

Figure 14:
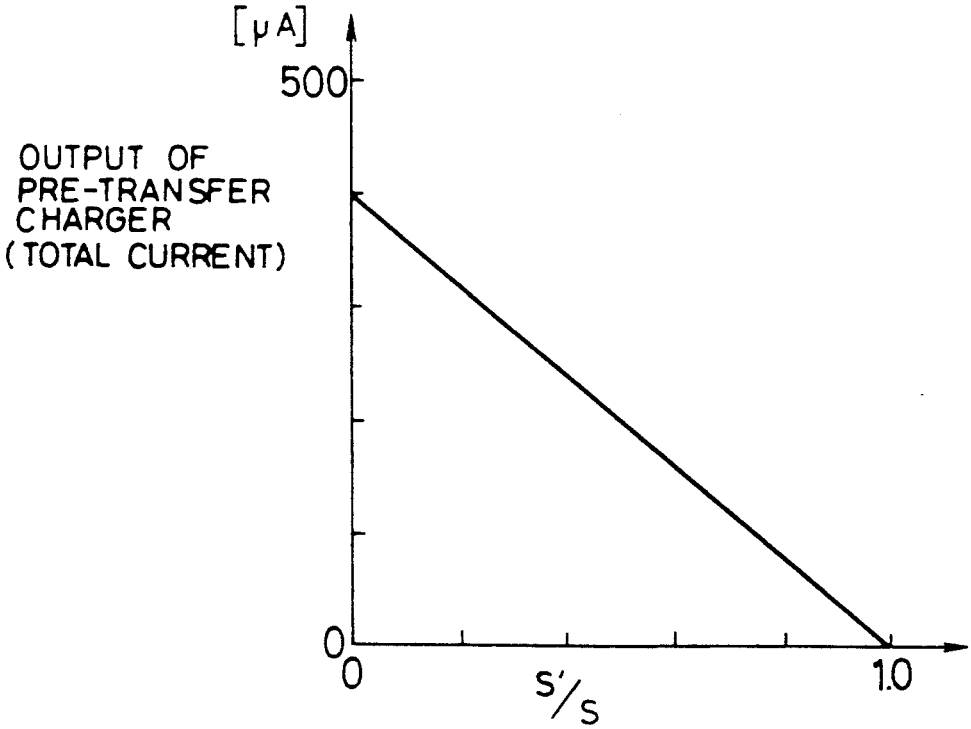
FIG. 14 is a graph showing the relation between the ratio of the output of an optical sensor after transfer to a reference residual value and the output of a charger before transfer.

When a change in the image density is detected by the ratio S'/S of the comparative residual value S' to the reference residual value S based on the characteristic shown in FIG. 11, in order to maintain a uniform amount of residual toner on the photoreceptor drum 1 after transfer, it is necessary to control the pre-transfer charger output as follows. As illustrated in FIG. 14, since the amount of toner remaining on the photoreceptor drum 1 becomes smaller as the comparative residual value S' becomes closer to the reference residual value S, the pre-transfer charger output is decreased. And, since the amount of toner remaining on the photoreceptor drum 1 increases when S' becomes smaller than S, the pre-transfer charger output is increased.

In the electrophotographic apparatus, a look-up table was prepared to relate the ratio S'/S to the pre-transfer charger output based on the above-mentioned relation. The lowering of the transfer efficiency is compensated by controlling the discharge output of the pre-transfer charger 5 by a pre-transfer charger output given by the look-up table.

The following description explains the process control of stabilizing the image quality.

Firstly, after adjusting the sensor output before transfer according to a toner patch, a toner patch is formed on the photoreceptor drum 1 and transferred to a transfer sheet. The comparative residual value S' is generated by the optical sensor 9 after transfer. The ratio of the comparative residual value S' to the reference residual value S is calculated. Based on the ratio S'/S and the above-mentioned relation, a pre-transfer charger output is determined. Thus, the amount of the toner remaining on the photoreceptor drum 1 after transfer is adjusted by controlling the discharge output of the pre-transfer charger 5 by the pre-transfer charger output.

As described above, the electrophotographic apparatus of this embodiment controls the pre-transfer charger output according to the sensor output after transfer. Therefore, even if the transfer efficiency varies due to a change in the developer, it is possible to restrain the image density from being lowered.

EMBODIMENT 6

The following description discusses a sixth embodiment of the present invention with reference to FIGS. 2, 15 through 17.

Figure 15:
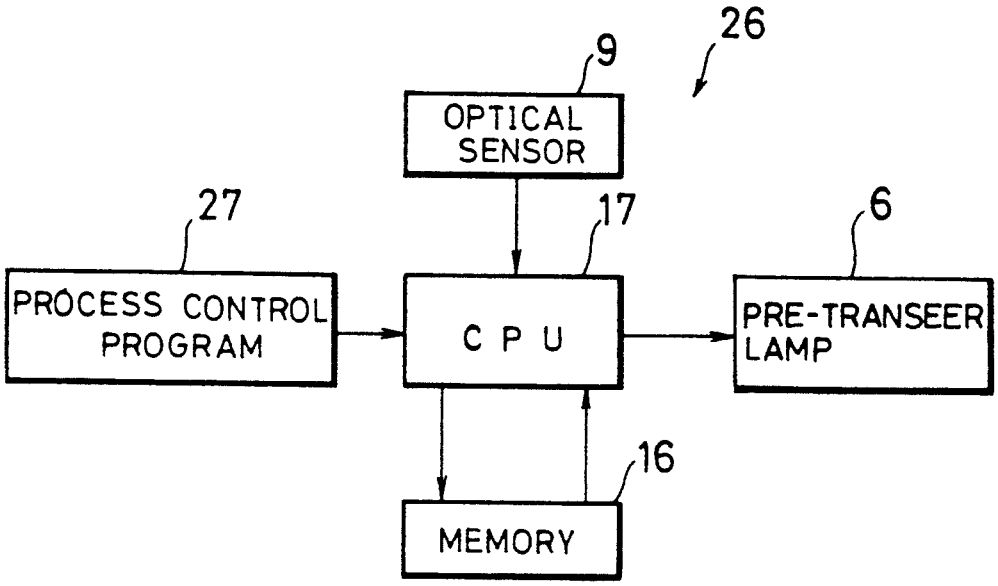
FIG. 15 is a block diagram illustrating a schematic structure of the process control section of the electrophotographic apparatus according to a sixth embodiment of the present invention.

As illustrated in FIG. 2, an electrophotographic apparatus of this embodiment has a processing section including the photoreceptor drum 1, a pre-transfer lamp 6 disposed in the vicinity of the photoreceptor drum 1. Moreover, as illustrated in FIG. 15, the electrophotographic apparatus has a process control section 26 as process control means. The process control section 26 includes the optical sensor 9, a process control program 27, the memory 16, and the CPU 17.

The CPU 17 stores the ratio of the sensor outputs before and after transfer as a reference transfer efficiency in the memory 16 when a total number of image forming operations performed is low. The CPU 17 controls the quantity of light of the pre-transfer lamp 6 (hereinafter referred to as PTL light quantity) so that a transfer efficiency equal to the reference transfer efficiency is obtained in stabilizing the image quality.

Thus, the process control section 26 functions as fifth control means as well as transfer control means when the CPU 17 executes the process control program 27.

Next, the relation between the transfer efficiency and the PTL light quantity is explained below.

Figure 16:
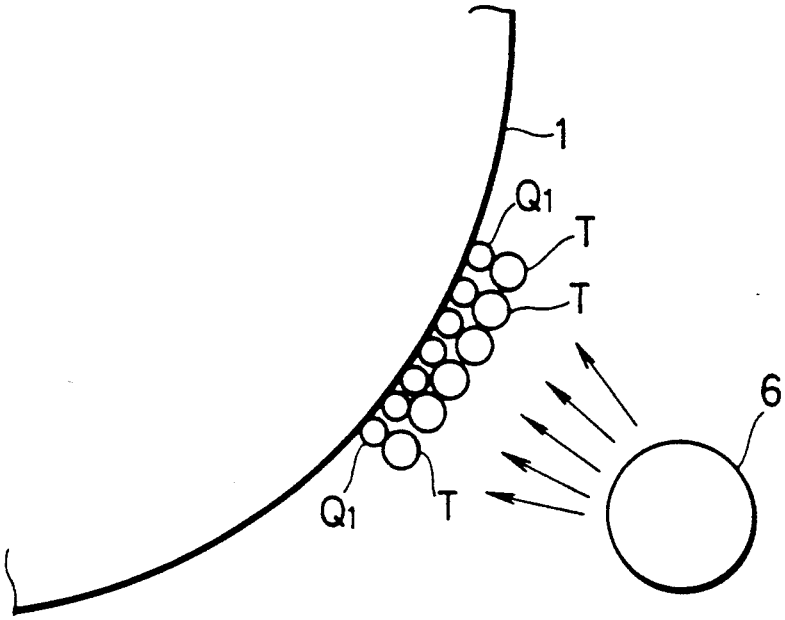
FIG. 16 is a view explaining how a pre-transfer lamp irradiates light on a photoreceptor drum carrying the toner image formed thereon before the transfer process.

As illustrated in FIG. 16, when the pre-transfer lamp 6 irradiates light on the photoreceptor drum 1, the charges $Q_1$ forming an electrostatic latent image are removed. Consequently, the adhesion or Coulomb force between the toner T and the photoreceptor drum 1 is weakened, resulting in an improved transfer efficiency.

Figure 17:
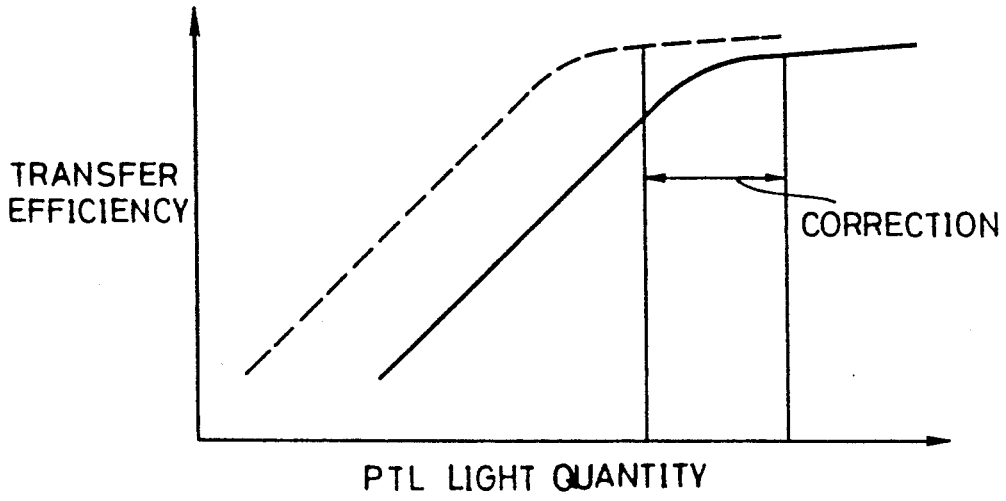
FIG. 17 is a graph showing the relation between the PTL light quantity and transfer efficiency.

FIG. 17 shows the relation between the PTL light quantity for removing charges and changes in the transfer efficiency. As shown in the broken line of FIG. 17, when a total number of image forming operations performed is low, the transfer efficiency improves as the PTL light quantity increases. However, the transfer efficiency is substantially saturated when the PTL light quantity exceeds a predetermined value.

In the electrophotographic apparatus, a look-up table was prepared to show a correction value for the PTL light quantity, corresponding to a lowering of the transfer efficiency. The lowering of the transfer efficiency is compensated by changing the PTL light quantity by the correction value given by the look-up table as shown in the solid line of FIG. 17. However, when the PTL light quantity increases excessively, the photoreceptor drum 1 is fatigued. It is therefore necessary to select a quantity of light which achieves a maximum transfer efficiency and minimum effects on the photoreceptor drum fatigue.

The following description explains the process control of stabilizing the image quality according to this arrangement.

Firstly, when not so many image forming operations have been performed, a toner patch is formed and is read by the optical sensor 9. The transfer efficiency is determined by the sensor outputs before and after transfer and stored as a reference transfer efficiency in the memory 16. Thereafter, a toner patch is formed every time a predetermined number of image forming operations are performed. The PTL light quantity is controlled so that the transfer efficiency measured when a toner patch is formed is equal to the reference transfer efficiency. The amount of toner remaining on the photoreceptor drum 1 after transfer is thus adjusted.

As described above, the electrophotographic apparatus of this embodiment controls the PTL light quantity to be always optimum while taking into account the relation between the PTL light quantity and the transfer efficiency, which varies intricately when there is a change in the developer or environment. Accordingly, it is possible to restrain the lowering of the image density.

EMBODIMENT 7

The following description discusses a seventh embodiment of the present invention with reference to FIGS. 2, 11, 18 and 19.

Figure 18:
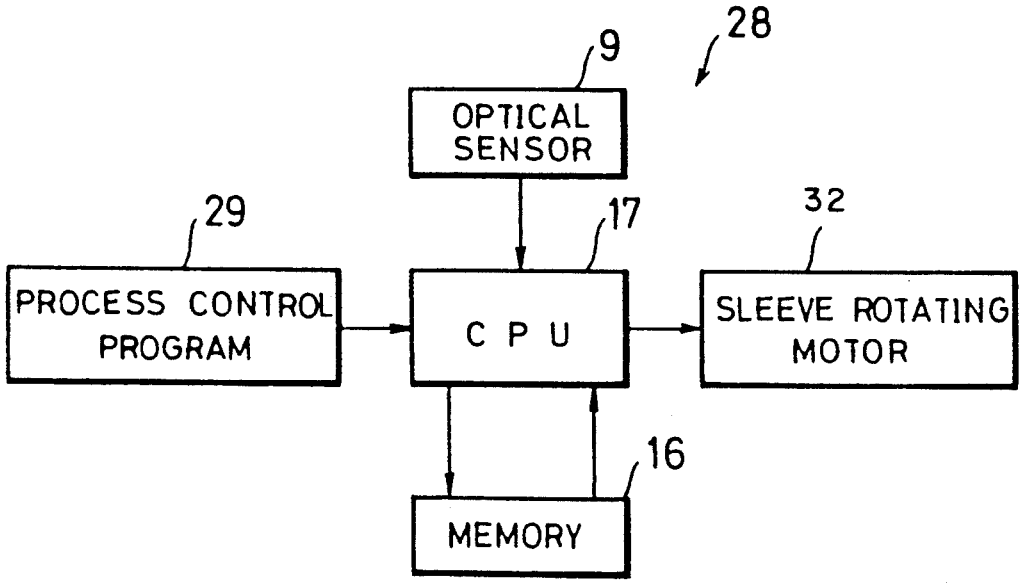
FIG. 18 is a block diagram illustrating a schematic structure of the process control section of the electrophotographic apparatus according to a seventh embodiment of the present invention.

As illustrated in FIG. 2, an electrophotographic apparatus of this embodiment has a processing section including the photoreceptor drum 1 and the development device 4 disposed in the vicinity of the photoreceptor drum 1. Moreover, as illustrated in FIG. 18, the electrophotographic apparatus has a process control section 28 as process control means. The process control section 28 includes the optical sensor 9, a process control program 29, the memory 16, and the CPU 17.

The CPU 17 stores in the memory 16 a sensor output after transfer as a reference residual value when a total number of image forming operations performed is low. Moreover, the CPU 17 calculates in advance the ratio of a potential (or experimental) value of a sensor output after transfer obtained in stabilizing the image quality to the reference residual value S. The potential value of the sensor output after transfer is hereinafter referred to as a comparative residual value S'. Then, the CPU 17 controls the amount of the developer to be supplied by controlling the rotation speed of a sleeve rotating motor 32 of the magnet roller 4*b* according to the ratio S'/S.

Thus, the process control section 28 functions as sixth control means as well as transfer control means when the CPU 17 executes the process control program 29.

The following description discusses the relation between the residual toner and the rotation speed of the sleeve. The rotation speed is a speed (mm/sec) measured at an arbitrary point on the sleeve.

Figure 19:
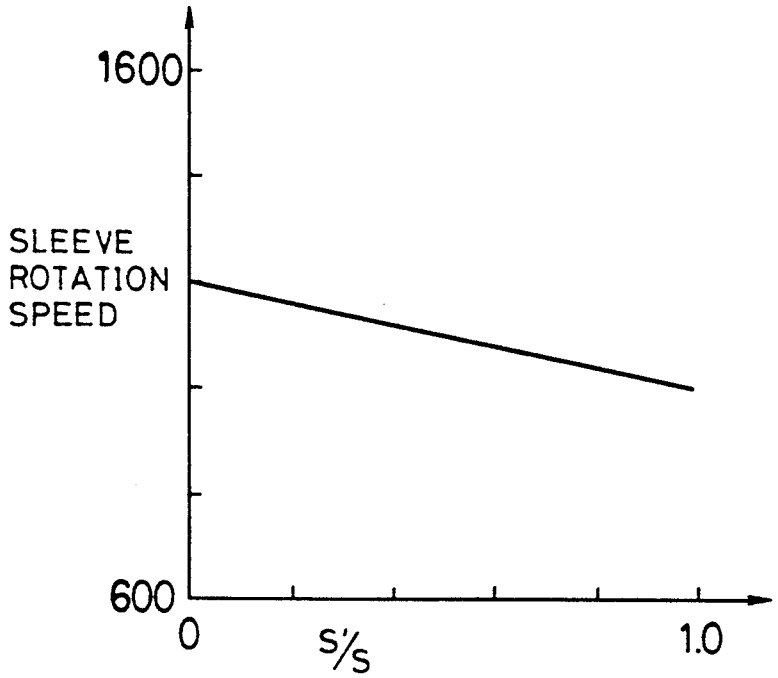
FIG. 19 is a graph showing the relation between the ratio of the output of an optical sensor after transfer to a reference residual value and the rotation speed of the sleeve.

Based on the characteristic shown in FIG. 11, a sleeve rotation speed at which an amount of the developer optimum for the ratio S'/S is transported is determined as shown in FIG. 19. In order to control a uniform amount of toner to remain on the photoreceptor drum 1 after transfer, it is necessary to reduce the sleeve rotation speed as S' becomes closer to S and to increase the sleeve rotation speed as S' becomes smaller than S. This is because the residual toner on the photoreceptor drum 1 becomes greater as S' becomes closer to S and the residual toner on the photoreceptor drum 1 becomes smaller as S' becomes smaller than S.

In the electrophotographic apparatus, based on this relation a look-up table was prepared to connect the ratio S'/S with a corresponding sleeve rotation speed. The amount of the developer to be supplied is controlled by rotating the sleeve at a speed determined through the look-up table, thereby compensating for a lowering of the transfer efficiency.

Next, the following description explains the control process of stabilizing the image quality according to this arrangement.

Firstly, after adjusting the sensor output before transfer using a toner patch, a toner patch is formed on the photoreceptor drum 1 and then transferred to a transfer sheet. The optical sensor 9 generates the comparative residual value S', and the ratio S'/S is calculated. A sleeve rotation speed is determined based on the ratio S'/S and the above-mentioned relation. Then, the sleeve is controlled to be rotated at the sleeve rotation speed. As a result, an amount of the developer corresponding to the ratio S'/S is supplied, and the amount of toner remaining on the photoreceptor drum 1 after transfer is adjusted.

EMBODIMENT 8

The following description discusses an eighth embodiment of the present invention with reference to FIGS. 2, 20 through 22.

Figure 20:
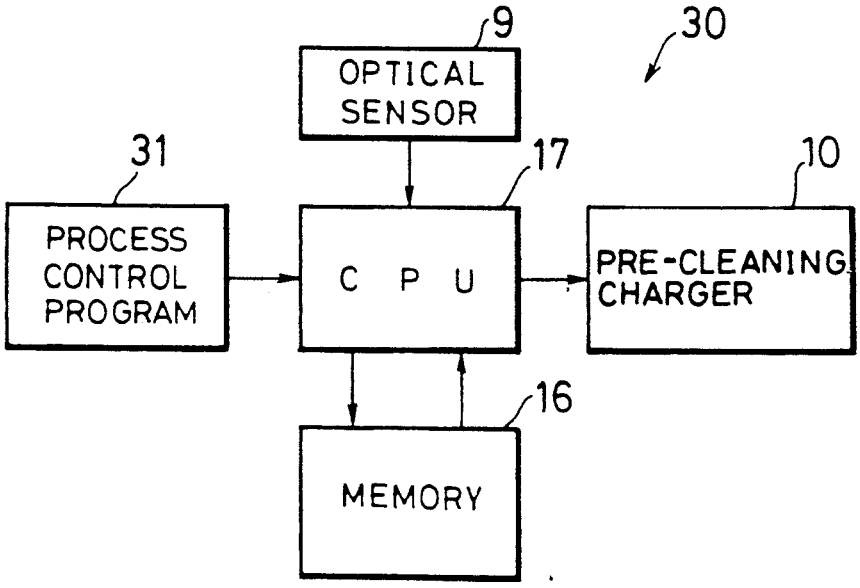
FIG. 20 is a block diagram illustrating a schematic structure of the process control section of an electrophotographic apparatus according to an eighth embodiment of the present invention.

As illustrated in FIG. 2, an electrophotographic apparatus of this embodiment has a processing section including the photoreceptor drum 1 and a pre-cleaning charger 10 disposed in the vicinity of the photoreceptor drum 1. Moreover, as illustrated in FIG. 20, the electrophotographic apparatus has a process control section 30 as process control means. The process control section 30 includes the optical sensor 9, a process control program 31, the memory 16, and the CPU 17. In this apparatus, the output of the pre-cleaning charger 10 is controlled according to transfer efficiency.

The relation between the transfer efficiency and the pre-cleaning charger output is explained below.

Figure 21:
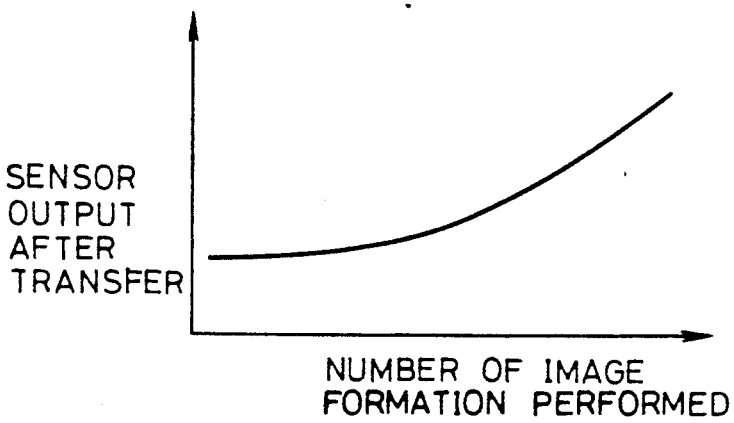
FIG. 21 is a graph showing the relation between the number of image forming operations performed and the output of an optical sensor after transfer.

In a copying machine, as illustrated in FIG. 21, as the number of image forming operations performed increases, the sensor output after transfer becomes higher. This is because that as the number of image forming operations performed increases, the amount of toner attracted to the photoreceptor drum 1 increases due to the degradation of the developer and the charging wire of the transfer device 7. Therefore, in order to achieve a stable cleaning performance of the cleaning device 11, it is necessary to establish the relation between the transfer efficiency and the pre-cleaning charger output as shown in FIG. 22.

Figure 22:
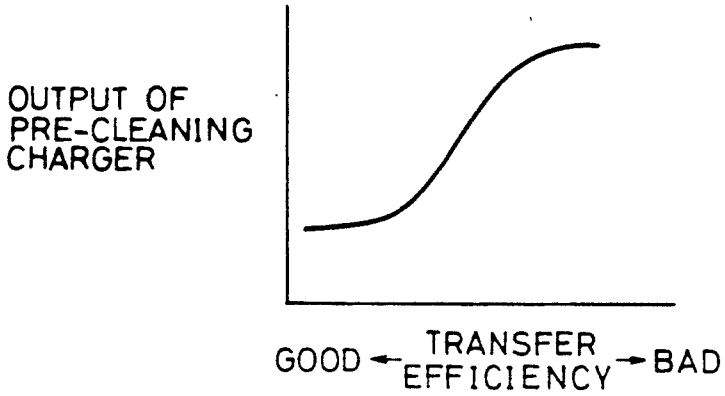
FIG. 22 is a graph showing the relation between transfer efficiency and the output of a pre-cleaning charger.

As shown in FIG. 22, when a good transfer efficiency is obtained, the pre-cleaning charger output is substantially uniform. On the other hand, when the transfer efficiency is low, the pre-cleaning charger output changes rapidly and then becomes substantially uniform. It is thus necessary to increase the pre-cleaning charger output according to the characteristic shown in FIG. 22 when the transfer efficiency is lowered.

The CPU 17 stores the characteristic shown in FIG. 22 in the memory 16, calculates a transfer efficiency from the outputs of the optical sensor 9 before and after transfer when stabilizing the image quality, and controls the output of the pre-cleaning charger 10 by causing the memory 16 to output a pre-cleaning charger output corresponding to the transfer efficiency.

The process control section 30 thus functions as seventh control means as well as transfer control means when the CPU 17 executes the process control program 31.

The following description explains the control process of adjusting the pre-cleaning charger output according to this arrangement.

Firstly, when the sensor output before transfer is adjusted based on a toner patch, the correction value is temporally stored in the memory 16. Then, when a toner patch is formed on the photoreceptor drum 1 and transferred to a transfer sheet, the optical sensor 9 generates a sensor output after transfer. This sensor output after transfer is stored in the memory 16. A transfer efficiency is calculated from the sensor outputs before and after transfer stored in the memory 16. Thus, the pre-cleaning charger output is controlled according to the transfer efficiency.

As described above, in the electrophotographic apparatus of this embodiment, the pre-cleaning charger output is controlled according to the sensor output after transfer. It is therefore possible to achieve a stable cleaning performance of the cleaning device 11 even when the transfer efficiency varies.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image-quality stabilizer for an electrophotographic apparatus comprising electrophotographic processing means, said electrophotographic processing means including a photoreceptor and transfer means, said image-quality stabilizer comprising:

optical detecting means for optically detecting an amount of toner deposited on said photoreceptor;

process control means for controlling said electrophotographic processing means so that an amount of toner forming a reference toner image on said photoreceptor is equal to a predetermined reference value;

transfer control means for controlling said transfer means so as to transfer a reference toner image formed after controlling said electrophotographic processing means to a transfer sheet; and reference-value adjusting means for adjusting the reference value based on a value detected by said optical detecting means after transferring the reference toner image to the transfer sheet.

2. The image-quality stabilizer for an electrophotographic apparatus according to claim 1, wherein said reference-value adjusting means adjusts the reference value based on a ratio of the value detected by said optical detecting means after the transfer of the reference toner image to a reference residual value, the reference residual value being obtained by said optical detecting means when the reference toner image for determining the reference value is transferred to the transfer sheet.

3. An image-quality stabilizer for an electrophotographic apparatus comprising electrophotographic processing means, said electrophotographic processing means including a photoreceptor, transfer means and separating means, said image-quality stabilizer comprising;

optical detecting means for optically detecting an amount of toner deposited on said photoreceptor;

process control means for controlling said electrophotographic processing means so that an amount of toner forming a reference toner image on the photoreceptor is equal to a predetermined reference value;

transfer control means for controlling said transfer means so as to transfer a reference toner image formed after controlling said electrophotographic processing means to a transfer sheet; and first control means for controlling an output of said transfer means so that a value detected by said optical detecting means after the transfer of the reference toner image is equal to a reference residual value, the reference residual value being obtained by said optical detecting means when the reference toner image for determining the reference value is transferred to the transfer sheet.

4. The image-quality stabilizer for an electrophotographic apparatus according to claim 3, wherein said first control means calculates a transfer efficiency based on the value detected by said optical detecting means after the transfer of the reference toner image, and controls the output of said transfer means so that the transfer efficiency becomes equal to a predetermined reference transfer efficiency.

5. The image-quality stabilizer for an electrophotographic apparatus according to claim 3, further comprising second control means for controlling an output of said separating means in accordance with the output of said transfer means controlled by said first control means.

6. The image-quality stabilizer for an electrophotographic apparatus according to claim 5, wherein said second control means controls the output of said separating means so that the output of said transfer means controlled by said first control means is proportional to the output of said separating means.

7. An image-quality stabilizer for an electrophotographic apparatus comprising electrophotographic processing means, said electrophotographic processing means including a photoreceptor, transfer means and charger means, said image-quality stabilizer comprising;

optical detecting means for optically detecting an amount of toner deposited on said photoreceptor;

process control means for controlling said electrophotographic processing means so that an amount of toner forming a reference toner image on said photoreceptor is equal to a predetermined reference value;

transfer control means for controlling said transfer means so as to transfer a reference toner image formed after controlling said electrophotographic processing means to a transfer sheet; and control means for controlling an output of said charger means so that a value detected by said optical detecting means after the transfer of the reference toner image is equal to a reference residual value, the reference residual value being obtained by said optical detecting means when the reference toner image for determining the reference value is transferred to the transfer sheet.

8. The image-quality stabilizer for an electrophotographic apparatus according to claim 7, wherein said control means relates in advance a difference between a value detected by said optical detecting means and the reference residual value to a correction value for the output of said charger means which is determined to be optimum for the difference, and controls the output of said charger means to be adjusted by a correction value corresponding to a difference actually detected.

9. An image-quality stabilizer for an electrophotographic apparatus comprising electrophotographic processing means, said electrophotographic processing means including a photoreceptor, transfer means and pre-transfer charger means used for removing charges on said photoreceptor immediately before a transfer operation, said image-quality stabilizer comprising:

optical detecting means for optically detecting an amount of toner deposited on said photoreceptor;

process control means for controlling said electrophotographic processing means so that an amount of toner forming a reference toner image on said photoreceptor is equal to a predetermined reference value;

transfer control means for controlling said transfer means so as to transfer a reference toner image formed after controlling said electrophotographic processing means to a transfer sheet; and control means for controlling an output of said pre-transfer charger means so that a value detected by said optical detecting means after the transfer of the reference toner image is equal to a reference residual value, the reference residual value being measured by said optical detecting means when the reference toner image for determining the reference value is transferred to the transfer sheet.

10. The image-quality stabilizer for an electrophotographic apparatus according to claim 9, wherein said control means relates in advance a ratio of a value detected by said optical detecting means after transfer to the reference residual value to an output of said pre-transfer charger means determined to be optimum for the ratio, and controls the output of said pre-transfer charger means to have a value corresponding to a ratio actually detected.

11. An image-quality stabilizer for an electrophotographic apparatus comprising electrophotographic processing means including a photoreceptor, transfer means and a light source used for removing charges on said photoreceptor immediately before a transfer operation, said image-quality stabilizer comprising:

optical detecting means for optically detecting an amount of toner deposited on said photoreceptor;

process control means for controlling said electrophotographic processing means so that an amount of toner forming a reference toner image on said photoreceptor is equal to a predetermined reference value;

transfer control means for controlling said transfer means so as to transfer a reference toner image formed after controlling said electrophotographic processing means to a transfer sheet; and control means for controlling a quantity of light of said light source so that a value detected by said optical detecting means after the transfer of the reference toner image is equal to a reference residual value, the reference residual value being obtained by said optical detecting means when the reference toner image for determining the reference value is transferred to the transfer sheet.

12. The image-quality stabilizer for an electrophotographic apparatus according to claim 11, wherein said control means relates a difference between a transfer efficiency measured after the transfer of the reference toner image and a predetermined transfer efficiency to a correction value which is determined to make the quantity of light optimum for the difference, and controls the quantity of light to be adjusted by .a correction value corresponding to a difference in the transfer efficiency actually measured.

13. An image-quality stabilizer for an electrophotographic apparatus comprising electrophotographic processing means, said electrophotographic processing means including a photoreceptor, transfer means and development means, said image-quality stabilizer comprising:

optical detecting means for optically detecting an amount of toner deposited on said photoreceptor;

process control means for controlling said electrophotographic processing means so that an amount of toner forming a reference toner image on said photoreceptor is equal to a predetermined reference value;

transfer control means for controlling said transfer means so as to transfer a reference toner image formed after controlling said electrophotographic processing means to a transfer sheet; and control means for controlling an amount of a developer to be supplied by said development means so that a value detected by said optical detecting means after the transfer of the reference toner image is equal to a reference residual value, the reference residual value being obtained by said optical detecting means when the reference toner image for determining the reference value is transferred to the transfer sheet.

14. The image-quality stabilizer for an electrophotographic apparatus according to claim 13, wherein said control means relates a ratio of a value detected by said optical detecting means to the reference residual value to an amount of the developer which is determined to be optimum for the ratio, and controls the amount of the developer to be supplied to have a value corresponding to a ratio actually detected.

15. The image-quality stabilizer for an electrophotographic apparatus according to claim 14, wherein said development means comprising a magnet roller for transporting the developer to said photoreceptor, and said control means adjusts a developer transporting speed of said magnet roller so as to control the amount of the developer to be supplied.

16. An image-quality stabilizer for an electrophotographic apparatus comprising electrophotographic processing means, said electrophotographic processing means including a photoreceptor, transfer means and pre-cleaning charger means for removing charges on said photoreceptor before a cleaning operation, said image-quality stabilizer comprising:

optical detecting means for optically detecting an amount of toner deposited on said photoreceptor;

process control means for controlling said electrophotographic processing means so that an amount of toner forming a reference toner image on said photoreceptor is equal to a predetermined reference value;

transfer control means for controlling said transfer means so as to transfer a reference toner image formed after controlling said electrophotographic processing means to a transfer sheet; and control means for calculating a transfer efficiency from values detected by said optical detecting means before and after transferring the reference toner image and for controlling an output of said pre-cleaning charger means in accordance with the transfer efficiency.

17. The image-quality stabilizer for an electrophotographic apparatus according to claim 16, wherein said control means relates a transfer efficiency to an output of said pre-cleaning charger means suitable for the transfer efficiency, and controls the output of said pre-cleaning charger means to have a value corresponding to a transfer efficiency actually detected.

* * * * *